US007530186B2

(12) United States Patent
Kaliner

(10) Patent No.: US 7,530,186 B2
(45) Date of Patent: May 12, 2009

(54) ARTICLE FOR DISPLAYING INDICIA AND HOLDING AN OBJECT ABOVE A CONTAINER LID

(76) Inventor: Bruce R. Kaliner, 6 Meadowlark Rd., Rye Brook, NY (US) 10573

( * ) Notice: Subject to any disclaimer, the term of this patent is extended or adjusted under 35 U.S.C. 154(b) by 319 days.

(21) Appl. No.: 11/391,165

(22) Filed: Mar. 27, 2006

(65) Prior Publication Data

US 2006/0219592 A1 Oct. 5, 2006

Related U.S. Application Data

(60) Provisional application No. 60/666,624, filed on Mar. 31, 2005.

(51) Int. Cl.
*G09F 3/00* (2006.01)

(52) U.S. Cl. ..... 40/324; 40/311; 366/129; 220/254.1

(58) Field of Classification Search ..... 40/324, 40/334, 611, 663, 660, 637, 652, 648, 311, 40/645; 220/254.1; 366/129
See application file for complete search history.

(56) References Cited

U.S. PATENT DOCUMENTS

| | | | | | |
|---|---|---|---|---|---|
| 1,486,789 | A * | 3/1924 | Nickel | 40/658 |
| 2,717,463 | A * | 9/1955 | Sindler | 40/324 |
| 2,793,842 | A * | 5/1957 | Bacon | 416/71 |
| 3,057,093 | A * | 10/1962 | Gallo | 40/645 |
| 3,325,929 | A * | 6/1967 | Mauchline | 40/658 |
| 4,381,623 | A * | 5/1983 | Koistinen | 47/48.5 |
| 2005/0284874 | A1 * | 12/2005 | Lucks | 220/712 |
| 2006/0016823 | A1 * | 1/2006 | Noon | 220/791 |
| 2007/0023442 | A1 * | 2/2007 | Auzenne | 220/801 |

* cited by examiner

*Primary Examiner*—Cassandra Davis

(57) ABSTRACT

An article according to the present invention is configured for placement in an opening formed in a container lid for displaying indicia and optionally holding an object. The article includes a body having a bottom plug portion that is configured to be received within the opening so as to substantial seal the opening. The article also includes an upper portion that is attached to the bottom plug portion and extends upwardly and radially outward therefrom and includes two opposing sections with an interior space formed therebetween for receiving and holding the object. At least one of the sections includes a surface for displaying indicia.

22 Claims, 3 Drawing Sheets

ARTICLE FOR DISPLAYING INDICIA AND HOLDING AN OBJECT ABOVE A CONTAINER LID

CROSS-REFERENCE TO RELATED APPLICATION

The present application claims the benefit of U.S. patent application Ser. No. 60/666/624, filed Mar. 31, 2005, which is hereby incorporated by reference in its entirety.

TECHNICAL FIELD

The present invention relates to an article that is intended to be disposed above and coupled to a container lid and more particularly, relates to an article that serves as an eye catching, marketing, sales and promotional tool by providing at least one surface for displaying indicia and an area for displaying and supporting an object above the container lid, as well as having a feature for sealing and plugging an opening formed in the container lid to permit the article to stand upright.

BACKGROUND

Typically, fluid consumer products, such as beverages and the like, are drank from a container, such as a cup, regardless of whether the beverage is of a heated type or a cold type. The construction of the container can vary based on whether the container is to hold a hot beverage in which case the container can be formed of a styrofoam or suitable paper material, or a cold beverage, in which case the container can be formed of a paper material. In order to maintain the temperature of the beverage, as well as seal the open end of the container, a lid is provided for releasable attachment to the open end of the container. The lid is typically formed of a plastic material and includes an annular shaped side wall or flange that engages and is coupled to a side wall of the container for securing the lid to the container.

The lid opening through which the beverage is dispensed from the interior of the container as the user draws the beverage therefrom either by inverting or tipping the container or by using a straw, etc. The lid opening can be formed in any number of different shapes and sizes and can be of the type that is always open or a type that is openable, as by pulling back a perforated tab ("pull back tab") or a type that is both openable and closeable. Many beverages are now dispensed in containers that are closed and sealed with lids that have a small spout structure with an opening formed in the spout for dispensing (drinking) the beverage. However, these lids merely function as a means for closing the open end of the container. FIG. 1 generally shows a container 100 that is sealed with a lid 110 that includes an opening 120 formed therethrough.

SUMMARY

An article according to the present invention is constructed for placement in an opening formed in a container lid for displaying indicia, such as marketing and sales information (e.g., advertisements) and optionally holding an object (e.g., a promotional object). The article includes a body having a bottom plug portion that is configured to be received within the opening so as to substantial seal the opening. The article also includes an upper portion that is attached to the bottom plug portion and extends upwardly and radially outward therefrom and includes two opposing sections with an interior space formed therebetween for receiving and holding the object. At least one of the sections includes a surface for displaying indicia.

In another aspect of the present invention, an article for placement in an opening formed in a container lid for providing a marketing and sales tool at a point-of-purchase includes a body having a bottom plug portion that is configured to be received within the opening so as to substantial seal the opening and sit upright with respect to a top surface of the lid. The body also has an upper portion that is attached to the bottom plug portion and extends upwardly therefrom and includes first and second opposing sections with an interior space formed therebetween for receiving and holding an object. The first and second sections are curved such that an upper end of the first section is disposed over an upper end of the second section, with the first section being a resilient member that can flex outwardly so as to facilitate placement of the object in the interior space. The first section of the body includes a surface for displaying indicia, such as printed matter, e.g., advertisement, corporate logo or an image, etc.

BRIEF DESCRIPTION OF THE DRAWING FIGURES

The foregoing and other features of the present invention will be more readily apparent from the following detailed description and drawing figures of illustrative embodiments of the invention in which.

DETAILED DESCRIPTION OF PREFERRED EMBODIMENTS

Figure 1:
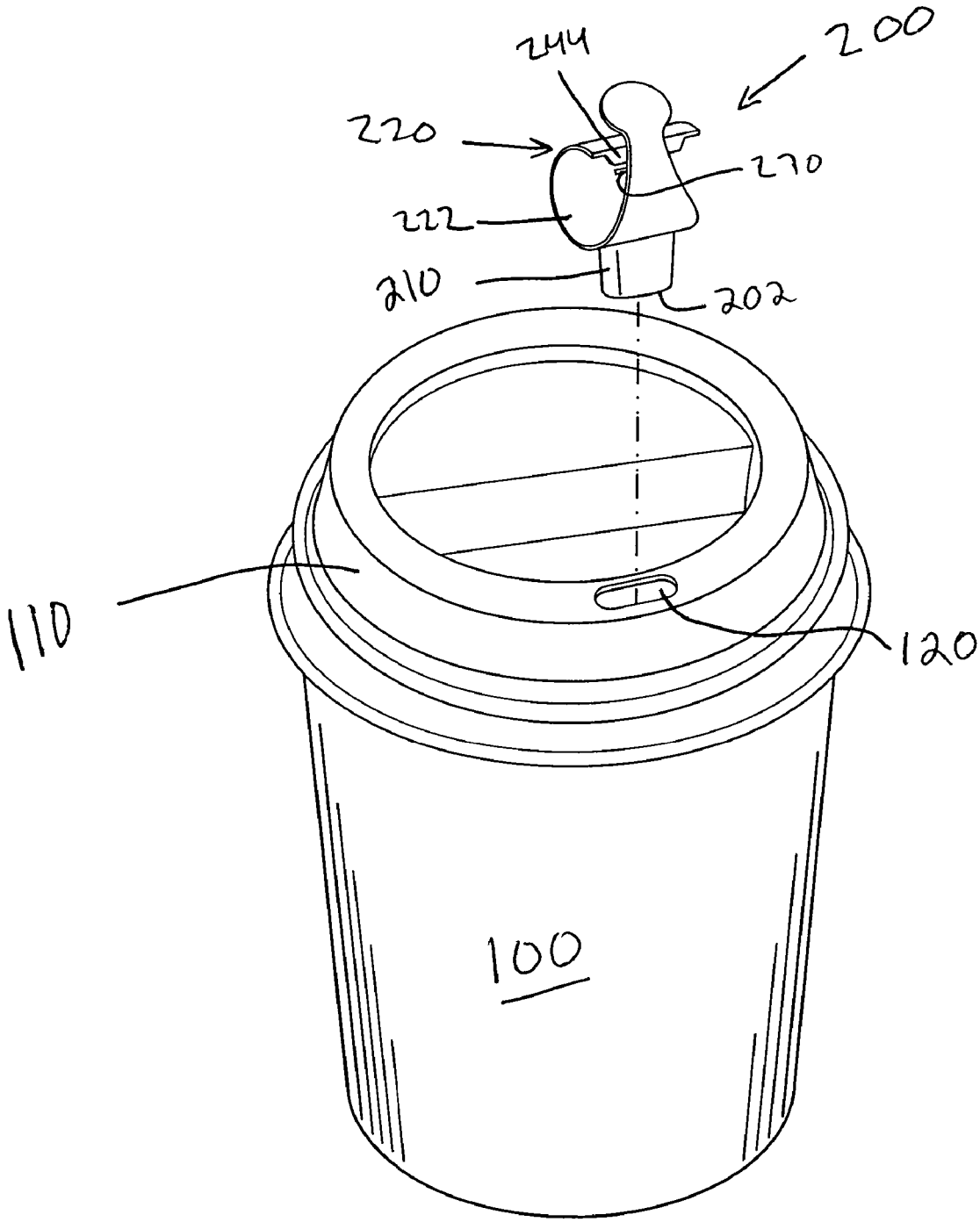
FIG. 1 is a perspective view of a conventional beverage container with a lid with an article according to one embodiment of the present invention being exploded therefrom.

FIGS. 1-4 illustrate an article 200 that is configured to be coupled to and stand upright from the container lid 110 and is configured to provide a means for displaying indicia, such as a corporate logo or name, advertisement, a graphic image, etc., so as to provide a point-of-purchase marketing tool as described in detail below. The article 200 can be referred to as being a stopper/topper since it is not only disposed on top of the container lid but also stands upright from the container lid 110 by means of plugging or forming a seal with the opening 120 formed in the lid 110.

The article 200 includes a bottom portion 210 that is constructed to function as a plug or seal member in that it has a shape and size that are complementary to the opening 120 of the lid 110 to permit it to be securely and sealingly received within the opening 120. For example, the bottom portion 210 (plug portion) can be in the form of a protrusion that is received within the opening 120 so as to seal the opening 120. The stopper 200 can thus be securely coupled to the lid 110 by means of a frictional fit between the bottom portion 210 and the peripheral lid wall that defines the opening 120.

In the illustrated embodiment, the bottom portion 210 is in the form of a cylindrical or tubular structure. When the bottom portion 210 has a substantially uniform diameter or width, this dimension is equal to or slightly greater than a diameter or width of the opening 120 so as to cause a frictional fit therebetween. The bottom portion 210 functions as a secure base for the upper portion of the article 200 as described in greater detail below. The bottom portion 210 also forms a seal with the opening 120 to prevent leakage through the opening 120 (sip hole) of the beverage in the container. While, the bottom portion 210 can be held within the opening 120 by means of a frictional fit, the bottom portion 210 can be held within the opening using other means or techniques, such as providing an annular recess along the outer surface of the bottom portion 210 which is complementary to the peripheral edge of the opening 120 so as to permit the peripheral edge to be snap-fittingly received within the annular recess.

Figure 2:
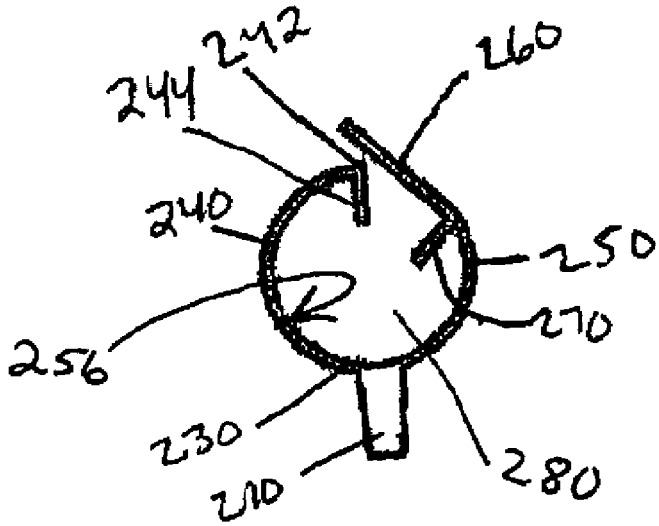
FIG. 2 is a side elevation view of the article according to FIG. 1.
Figure 3:
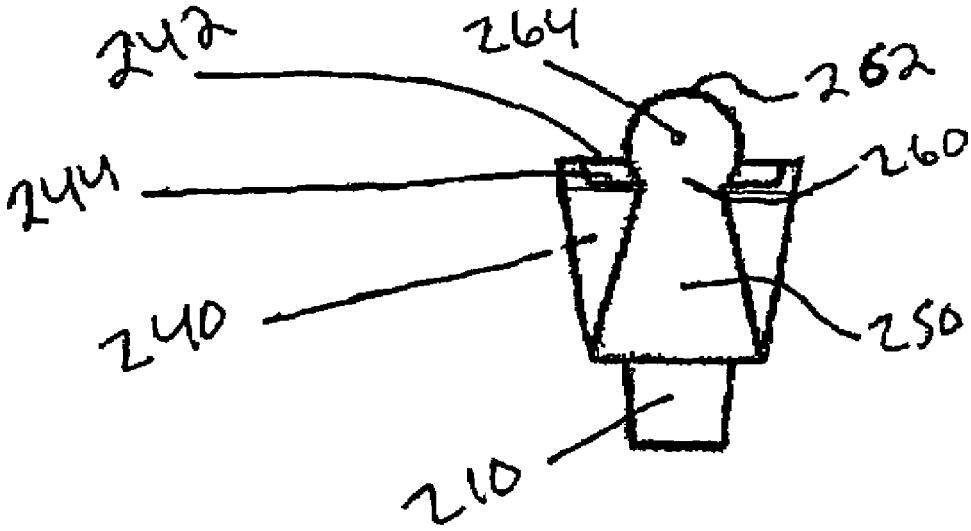
FIG. 3 is a front elevation view of the article of FIG. 2.

It will also be appreciated that as shown in FIGS. 2-3, the bottom portion 210 can be a tapered structure in that the bottom portion 210 can have a downward taper toward a bottom end 202 of the article 200. The incorporation of a taper into the bottom portion 210 facilitates the formation of a frictional fit between the article 200 and the peripheral lid wall that defines the opening 120.

In both means for coupling the article 200 to the lid 110, the article 200 is positioned upright and preferably at a right angle relative to the top of the lid 110. The bottom portion 210 thus functions to secure and make steady the remaining structure of the article 200.

The bottom portion 210 can be solid or hollow in construction as when it has a tubular structure and can be made from any number of different materials, including paper, plastic, or even a hardened food substance, such as a hard candy that is made of sugar or a sugar substitute. The bottom portion 210 can be formed in any number of different sizes depending upon the size of the opening 120 so that a secure sealing (plugging) of the opening 120 results.

Figure 4:
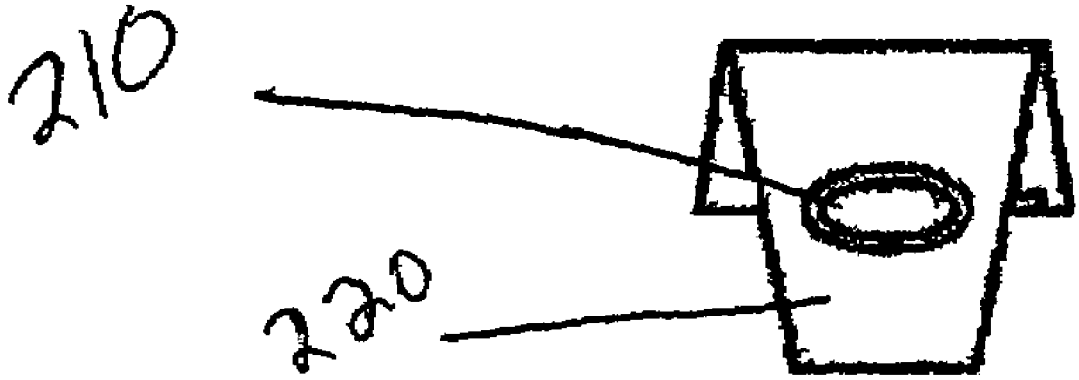
FIG. 4 is a bottom plan view of the article of FIG. 2.

The article 200 also includes an upper portion 220 that is defined by a body 222 that includes a first section 230 that is securely attached to the bottom portion 210 and can have an arcuate shape. The body 222 also includes a second section 240 that is integrally attached to the first section 230 and can be in the form of an arcuate section that terminates at an upper end 242 with a lip 244. The lip 244 is bent down towards the bottom portion 210 and in one embodiment, a vertical plane that contains the lip 244 extends through the bottom portion 210. As shown in FIGS. 2-4, the second section 240 does not have to have a continuous, uniform width from the first section 230 to the lip 244. In other words and as shown in FIG. 3, the second section 240 can have a tapered construction, such as downward taper toward the first section 230. In addition and as illustrated in FIGS. 3-4, the lip 244 can have a width that is different from the width of the upper end 242. For example, in the illustrated embodiment, the width of the lip 244 is less than the width of the upper end 242.

A third section 250 is integrally attached to the first section 230 opposite the second section 240 and has a substantially arcuate shape except that a free end portion of the third section 250 is in the form of a planar portion 260 that terminates in a distal end 262 that preferably is disposed over the upper end 242 of the second section 240. The distal end 262 of the third section 250 can extend over a portion of the second section 240 so that it lies outside of the vertical plane that contains the lip 244.

As with the second section 240, the third section 250 does not have to have a continuous, uniform width from the first section 230 to the distal end 262. In other words and as shown in FIG. 3, the second section 240 can have a tapered or irregular construction, such as downward taper toward the distal end 262. In the illustrated embodiment, the third section 250 has an inward taper until a distal end region of the third section 250 which is in the form of a circular shaped segment 264. Both the circular shaped segment 264 and the tapered section of the third section 250 are preferably contained within the same plane.

This circular shaped segment 264 can provide a tab or the like for the customer to grasp and manipulate the third section 250 relative to the other sections. For example, the circular shaped segment 264 can function as a grasp or handle that permits the third section 250 to be pulled outwardly in a direction away from the second section 240 so as to open up the interior space and permit placement and/or removal of the object that is intended to be securely contained and held therein.

The third section 250 also includes a tab or flange 270 that is formed on an inner surface 256 of the third section 250 such that it extends inwardly toward the second section 240 that is formed opposite the third section 250.

The first, second and third sections 230, 240, 250 substantially form a circular shaped structure, with the exception of the planar portion 260, and defined an interior space 280 that is formed between the sections of the upper portion 220.

As with the bottom portion 210, the upper portion 220 can be formed of any number of materials; however, the bottom portion 210 and the upper portion 220 are typically formed of the same material. In other words, the upper portion 220 can be formed of paper, plastic, or a hardened food substance, such as hard candy.

When the article 200 is formed as a single, unitary part, as by an injection molding process, the upper portion 220 is integrally attached to the bottom portion 210.

It will be appreciated that according to one aspect of the present invention, the article 200 functions as an eye catching marketing, sales and promotional tool since the article 200 is constructed to take advance of the unused "real estate" or space that exists above the lid 110. In other words, the article 200, and in particular, the upper portion 220 thereof is constructed to provide surface areas on which indicia, such as a corporate logo or other text and/or images, can be presented and in one embodiment, one or more advertisements can be provided on one or more surface areas of the upper portion 220.

In particular, indicia, such as an advertisement, etc., can be provided on either the outer surface of the second section 240 and/or it can be provided on the outer surface of the third section 250 and in particular, the other surface of the planar portion 260. Both of these outer surfaces face the consumer and in particular, the planar portion 260 (e.g., circular shaped segment 262) is angled so that the consumer can easily view the indicia that will face out toward the consumer and at least a portion of the outer surface of the second section 240 faces the consumer to permit easy viewing thereof. Both of these surfaces can be used to display printed indicia.

In addition, the article 200 is configured so that it can firmly grasp a small object, such as a candy treat, mint, trinket, fortune, coupon, etc., in such a way that it is prominently "floated" above the lid 110. In this manner, the article 200 can either be presented in an "unloaded" condition (mode) or a "loaded" condition (mode) where the object is displayed. In the unloaded condition, the article 200 is designed to act as a miniature billboard that is easily coupled to the lid 110 and displays some type of indicia, such as a company name and/or logo or other printed indicia or a theme. The article 200 can be keyed into particular holidays or seasons and can therefore, be molded and/or colored to a particular silhouette shape or used to display indicia (an imprinted or inked image that is attached to the surface (as by an adhesive)) that relates to the holiday, season or theme. For example, the article 200 can be configured to display a red heart for Valentines day, an orange pumpkin for Halloween, a bunny rabbit for Easter, a turkey for Thanksgiving, a Christmas tree or snowman for winter, leaves for fall, tulips for spring, etc. In addition, special occasions, such as national holidays, corporate celebrations or milestones, athletic events (Olympic rings), etc., can be displayed. In other words, the third section 250 can be constructed to have a particular shape (e.g., Christmas tree) that relates to a theme or the displayed indicia.

The lip 244 and flange 270 can serve to engage and grasp the object or at least present interference so that the object is contained within the interior space and does not so easily slide or otherwise become dislodged from the interior space. These members (lip 244 and flange 270) thus serve as retaining members or tabs to better position and hold the object in the interior space.

In the loaded condition or mode, the article 200 offers patrons a number of either sellable or give-a-way items. It will also be appreciated that the article 200 can simultaneously be provided in the loaded and unloaded modes since the article 200 can both display indicia in the upper portion 220 and can grasp and hold the object/display item. For example, some items that can be grasped and held by the article 200 for display to the customer include but are not limited to candy treats, charms, fortunes, collectibles, promotional items, paper advertisement or coupon, etc. The loaded item simply snaps into and out of the interior space of the article 200. In terms of food products that can be provided and loaded into this interior space include but are not limited to a Hershey Kiss®, a Tootsie Roll®, a Life Saver®, a mint, a chocolate heart, Easter egg, a marshmallow treat or some other type of candy. Even a sugar cube or packet of sugar or small cream container, can be provided in the interior space and packaged with the article 200. Other items that can be loaded into the interior space include but are not limited to fortunes, games of chance, lucky numbers, good luck charms, novelties (e.g., pin jewelry, snow globe, toy, etc.), holiday cheers, greetings, sweepstakes, recipes, promotions, etc.

The article 200 is also particularly well suited for use in marketing applications and in particular, for sales and cross or corporate alliance marketing, the article 200 can provide coupons, announce new products and promotions, as well as give out samples. The article 200 can also act as a miniature vending machine since a vast number of small objects can be loaded into the interior of the article 200 and thus, it can be easily integrated into any marketing plan or sales drive.

Thus, the article 200 provides both a means for displaying indicia and/or means for displaying an object at a point of purchase.

It will also be appreciated that the article 200 can be provided in any number of different colors, shapes and sizes and formed of a number of different products. If the entire article 200 is made out of hardened sugar or a sugar substitute and after the use of the article 200 is completed, the article 200 can simply be dropped into the beverage for sweetening thereof. Alternatively, if either the bottom portion 210 or the top portion 220 is formed of sugar or sugar substitute, this particular portion can be used to simultaneously stir and sweeten the beverage.

As part of a marketing or sales plan or at a customer's request to seal the opening 120 (sip hole), the server or employee simply inserts the bottom portion 210 into the opening 120 such that the article 200 is securely coupled to the lid 110 in an upright manner with the indicia and/or object being visible when it is in place. The customer simply removes the article 200 when it is time to drink the beverage and can re-insert the article 200 into the opening 120 if the beverage needs to be resealed or the customer wants to display the indicia and/or object. The article 200 is designed to be disposable, but by the same token, a marketing program can make the article 200 into a collectible/tradable trinket item. For example, a professional sports team can have various player nights where the indicia that is displayed on the upper portion 220, such as on the outer surface of the second section 240 or the planar portion 260, can be in the form of an image or photo of a particular player or a player's name or number. The articles 200 from the various promotional nights can be collected.

It will also be appreciated that the stopper according to the present invention can be constructed so that is can be used with "pull back" tab type lids that are common for beverages, such as coffee. More specifically, a section of the lid is perforated along two cut lines that extend to the lip of the lid and therefore, to expose the opening in the lid through which the beverage flows, the user simply tears back (lifts) the perforated portion to create the opening. The article can be constructed so that the bottom plug portion is designed to plug the opening formed by the tear back tab of the lid and in particular, the stopper can include side flanges that serve to engage the opposing sides of the lid that define the opening. More specifically, each of the flanges that extends outwardly from the body of the bottom plug portion includes a groove formed in its distal end that is designed to receive the peripheral side lid wall that defines a side of the opening formed by the tear back tab. The flanges thus engage the peripheral sides of the lid and act as legs that brace the stopper and permit it to stand and be supported in an upright manner. It will also be appreciated that the stopper can be constructed to merely be frictionally fit within the opening in the lid and therefore, the side flanges are eliminated.

It will be understood that the articles of the present invention can be provided in any number of different colors, shapes and sizes and formed of a number of different products without departing from the scope of the present invention as set forth in the claims set forth herein, and equivalents thereof.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. An article for placement in an opening formed in a container lid for displaying indicia and optionally holding an object comprising: a body having a bottom plug portion that is configured to be received within the opening so as to substantial seal the opening and an upper portion that is attached to the bottom plug portion and extends upwardly and radially outward therefrom and includes two opposing sections having arcuate surfaces with an interior space formed therebetween in the form of an arcuate cradle for receiving and holding the object, wherein one of the sections terminates in a lip formed at an upper edge thereof, with the lip being directed down towards the bottom plug portion and lying in a vertical plane that extends through the bottom plug portion and wherein at least one of the surfaces is suitable for displaying indicia.

2. The article of claim 1, wherein the bottom plug portion comprises an elongated plug that is shaped and sized to form a frictional fit with a peripheral edge of the lid that defines the opening.

3. The article of claim 1, wherein the bottom plug portion has a tapered construction to permit a frictional fit with a peripheral edge of the lid that defines the opening.

4. The article of claim 1, wherein the bottom plug portion is a tubular structure.

5. The article of claim 1, wherein an upper end of one section is disposed above an upper end of the other section.

6. The article of claim 1 , wherein at least one of the sections of the upper portion has a tapered construction.

7. The article of claim 1 , wherein one section of the upper portion has an enlarged tab formed at an upper end of the one section for displaying the indicia on an outer surface thereof, with the enlarged tab being disposed above the upper end of the other section.

8. The article of claim 1, wherein a cross-section of the two sections of the upper portion has a substantially circular shape.

9. The article of claim 1, wherein the indicia is selected from the group consisting of: a corporate logo or name, an image, and text.

10. The article of claim 1, wherein at least one of the bottom plug portion and the upper portion is formed of an edible material.

11. The article of claim 10, wherein the edible material comprises sugar or sugar substitute.

12. The article of claim 1, wherein the indicia is in the form of a decal that is adhesively secured.

13. An article for placement in an opening formed in a container lid for displaying indicia and optionally holding an object comprising: a body having a bottom plug portion that is configured to be received within the opening so as to substantial seal the opening and an upper portion that is attached to the bottom plug portion and extends upwardly and radially outward therefrom and includes two opposing sections with an interior space formed therebetween for receiving and holding the object, wherein at least one of the sections includes a surface for displaying indicia wherein the upper portion is formed of a flexible material to permit one section to be resiliently flexed outward relative to the other section, wherein one section has an enlarged tab segment formed at an upper end of the one section for displaying the indicia on an outer surface thereof, with the enlarged tab segment being disposed above the upper end of the other section so as to provide a grasp for flexing the one section relative to the other section.

14. The article of claim 13, wherein an upper end of the enlarged tab segment is offset from a vertical plane that contains an upper end of the other section and extends through the bottom plug portion.

15. A method for displaying marketing and sales information on a lid that is constructed to attach to a container holding a beverage comprising the steps of: forming an article according to claim 13; disposing printed indicia that represents marketing and sales information on the surface such that it can be viewed by a consumer; and inserting the bottom plug portion of the article into the lid so as to substantially form a seal between the article and the lid resulting in the article standing upright relative to the lid.

16. An article for placement in an opening formed in a container lid for providing a marketing and sales tool at a point-of-purchase comprising: a body having a bottom plug portion that is configured to be received within the opening so as to substantial seal the opening and sit upright with respect to a top surface of the lid, and an upper portion that is attached to the bottom plug portion and extends upwardly and radially outward therefrom and includes first and second opposing sections with an interior space formed therebetween for receiving and holding an object, wherein the first and second sections are curved such that an upper end of the first section is disposed over an upper end of the second section, with the first section being a resilient member that can flex outwardly so as to facilitate placement of the object in the interior space, the first section including a surface for displaying printed matter including at least one of a corporate logo, corporate name, an advertisement, and a graphic image.

17. The article of claim 16, wherein the first section has an inwardly tapered section and an enlarged tab section formed at the upper end, with the enlarged tab formed by a reverse outward taper from the inwardly tapered section.

18. The article of claim 17, wherein the indicia is in the form of at least one of test and an image that is located on the enlarged tab section.

19. A method for displaying marketing and sales information on a lid that is constructed to attach to a container holding a beverage comprising the steps of: forming an article according to claim 1 disposing printed indicia that represents marketing and sales information on at least one of the surfaces such that it can be viewed by a consumer; and inserting the bottom plug portion of the article into the lid so as to substantially form a seal between the article and the lid resulting in the article standing upright relative to the lid.

20. A method for displaying marketing and sales information on a lid that is constructed to attach to a container holding a beverage comprising the steps of: forming an article according to claim 16; disposing printed indicia that represents marketing and sales information on the surface such that it can be viewed by a consumer; and inserting the bottom plug portion of the article into the lid so as to substantially form a seal between the article and the lid resulting in the article standing upright relative to the lid.

21. An article for placement in an opening formed in a container lid for displaying indicia and optionally holding an object comprising: a body having a bottom plug portion that is configured to be received within the opening so as to substantial seal the opening and an upper portion that is attached to the bottom plug portion and extends upwardly and radially outward therefrom and includes two opposing arcuate sections with an arcuate interior space formed therebetween for receiving and holding the object, wherein at least one of the sections includes a surface for displaying indicia, wherein the indicia is imprinted on an outer surface of at least one section of the upper portion.

22. A method for displaying marketing and sales information on a lid that is constructed to attach to a container holding a beverage comprising the steps of: forming an article according to claim 21; disposing printed indicia that represents marketing and sales information on the surface such that it can be viewed by a consumer; and inserting the bottom plug portion of the article into the lid so as to substantially form a seal between the article and the lid resulting in the article standing upright relative to the lid.

* * * * *